US007814836B2

(12) United States Patent
Saxby

(10) Patent No.: US 7,814,836 B2
(45) Date of Patent: Oct. 19, 2010

(54) BLANK CARTRIDGE

(75) Inventor: Michael Ernest Saxby, Bexhill-on-Sea (GB)

(73) Assignee: UTM IP Limited, Suffolk (GB)

( * ) Notice: Subject to any disclaimer, the term of this patent is extended or adjusted under 35 U.S.C. 154(b) by 44 days.

(21) Appl. No.: 11/911,698

(22) PCT Filed: May 8, 2006

(86) PCT No.: PCT/GB2006/001679

§ 371 (c)(1),
(2), (4) Date: Apr. 22, 2008

(87) PCT Pub. No.: WO2006/120420

PCT Pub. Date: Nov. 16, 2006

(65) Prior Publication Data

US 2009/0211482 A1 Aug. 27, 2009

(30) Foreign Application Priority Data

May 10, 2005 (GB) ..... 0509455.2

(51) Int. Cl.
*F42B 8/00* (2006.01)

(52) U.S. Cl. ..... 102/444; 102/447; 102/498; 102/529

(58) Field of Classification Search ..... 89/28.2, 89/29; 42/77; 102/433–434, 444, 446–447, 102/498, 529
See application file for complete search history.

(56) References Cited

U.S. PATENT DOCUMENTS

| | | | | |
|---|---|---|---|---|
| 5,421,263 | A * | 6/1995 | Ruohonen | 102/435 |
| 6,439,123 | B1 * | 8/2002 | Dionne et al. | 102/430 |
| 6,848,208 | B1 | 2/2005 | Kirschner | 42/77 |
| 2002/0162475 | A1 * | 11/2002 | Saxby | 102/446 |

FOREIGN PATENT DOCUMENTS

| | | | |
|---|---|---|---|
| FR | 2394779 | | 6/1977 |
| GB | 2319076 A | * | 5/1998 |
| GB | 2353584 A | | 2/2001 |

* cited by examiner

*Primary Examiner*—J. W Eldred
*Assistant Examiner*—Gabriel J Klein
(74) *Attorney, Agent, or Firm*—Workman Nydegger

(57) ABSTRACT

A blank cartridge (1) comprises a cartridge casing (2) with a first primer (18); a piston (9) with a head (10) and an arm (11); and an expansion chamber located between said primer (18) and the head of the piston (10), wherein, following detonation of the primer, the piston slidably displaces substantially within the casing (2) of said cartridge (1).

12 Claims, 7 Drawing Sheets

BLANK CARTRIDGE

FIELD OF THE INVENTION

The invention relates to blank cartridges as well as gun barrels to accommodate such cartridges.

BACKGROUND TO THE INVENTION AND PRIOR ART KNOWN TO THE APPLICANT(S)

The closest prior art known to the applicant is of its own prior patent application published as GB2353584. This prior art document concerns blank training cartridges for a self-loading gun. The cartridges of this prior published invention expand following the detonation of its primers. The cartridge shown in this document expands rearward through a piston which has exposed portions from the cartridge's casing. Consequently, the profile of the cartridge changes following detonation as it expands in overall length. The expansion of these cartridges is particularly useful for cycling self-loading guns.

The main problems of these prior art cartridges are:

a) Unreliable feeding from a magazine;

b) Unreliable cycling of heavier calibre guns; and c) Relatively poor ejection of spent rounds.

SUMMARY OF THE INVENTION

In its broadest independent aspect, the invention provides a blank cartridge comprising a cartridge casing with a first primer; a piston with a head and an arm; and an expansion chamber between said primer and the head of the piston; wherein, following detonation of the primer, the piston slidably displaces substantially within the casing of said cartridge.

This combination of features is particularly advantageous because it can allow the cartridge to be formed with a profile similar to a live round. Consequently, it provides excellent feeding from the gun's magazine as well as improving the ejection of the spent round. A further advantage of this configuration is that it allows the achievement of improved energy levels for cycling the gun's mechanism. A further advantage is that it allows the safety to be improved as compared to the safety levels achieved in the prior art.

In a subsidiary aspect in accordance with the invention's broadest independent aspect, prior to firing, the front of the cartridge forms between the casing and the piston a recessed portion; whereby the front of the casing can fit around a projection formed in the breech of a gun and, following detonation, during expansion, the piston's arm abuts against the projection to tend to oust the cartridge from the breech.

This configuration is particularly advantageous because it allows improved localisation of the cartridge within the breech as well as improved ejection of the spent round.

In a further subsidiary aspect, the expansion chamber forms a substantially closed chamber between the casing and the piston where the piston head incorporates a seal to prevent the propellant gases from the explosion of the first primer escaping the expansion chamber. This minimises the escape of propellant gases whilst achieving close simulation to live firing. It therefore minimises the amount of harmful gases which could otherwise escape the cartridge.

In a further subsidiary aspect, the piston incorporates a second primer and a channel extending from the second primer through the arm of the piston; and the expansion chamber incorporates a projectile which is projected following detonation by the explosion of the first primer onto the second primer. This configuration allows a high level of noise to be generated to closely simulate the noise of a live cartridge.

In a further subsidiary aspect, the invention provides a gun barrel shaped and configured to accommodate a cartridge according to any of the preceding aspects. The use of a gun barrel shaped and configured in this manner will allow reliable feeding from a magazine, reliable cycling of heavier calibre guns and improved ejection of spent rounds as compared to the prior art.

DETAILED DESCRIPTION OF THE FIGURES

Figure 1:
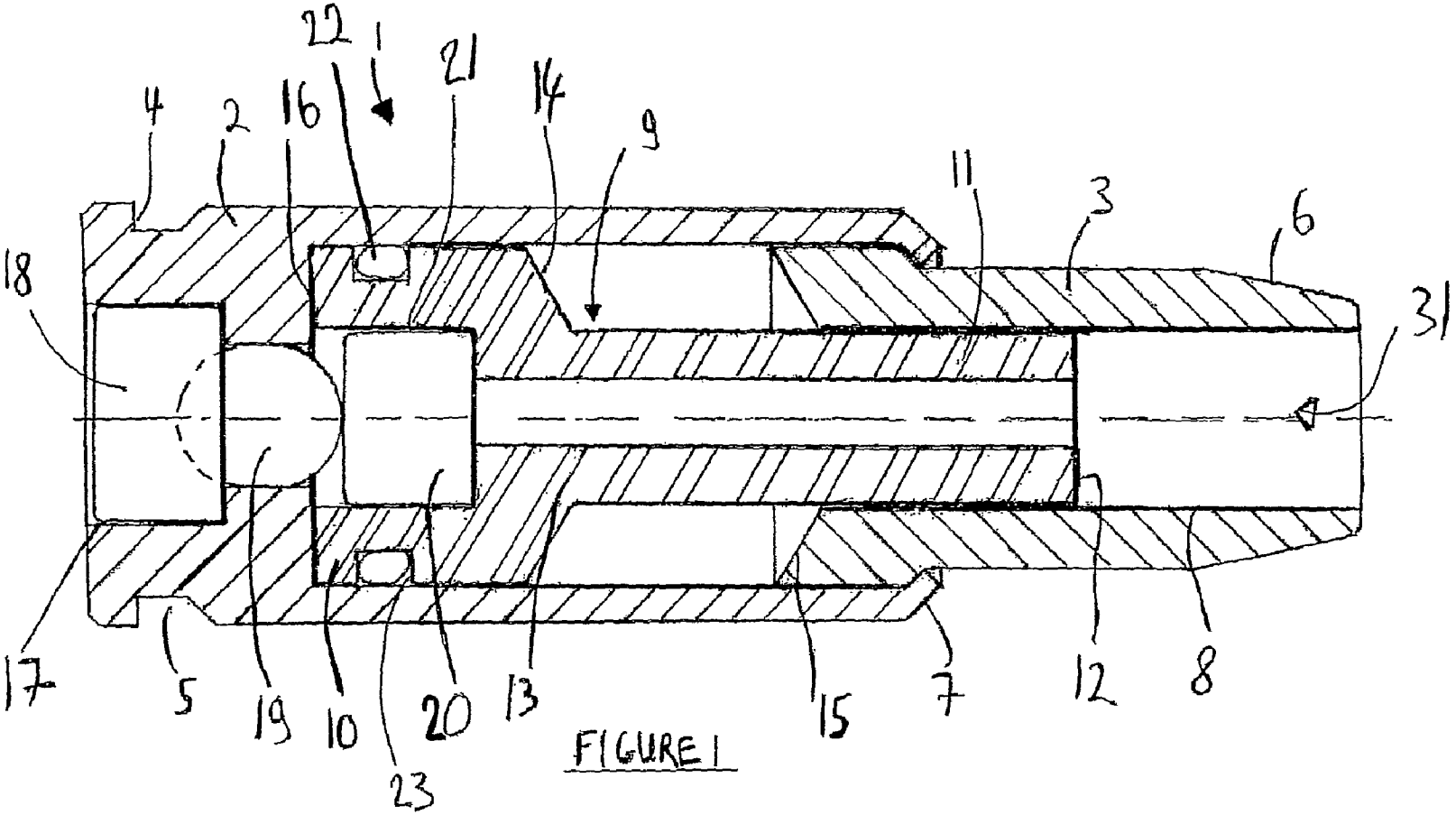
FIG. 1 shows a cross-sectional view of a blank cartridge prior to detonation.

FIG. 1 generally shows a cartridge 1 formed of a rear casing portion 2 and a front casing portion 3. The rear most portion of rear portion 2 incorporates a flange 4 and a recessed portion 5. Rear casing portion 2 is of a first diameter which exceeds the second diameter of front portion 3 so that the outer profile of the cartridge closely resembles a live cartridge profile. Front portion 3 is tapered at its front most portion 6. In an alternative configuration, the edges of the cartridge may also be rounded. A further tapered portion 7 is provided between the first diameter and the second diameter of the outer casing of the cartridge. The rear portion 2 and the front portion 3 are joined together by any appropriate means selected by the person skilled in the art from known alternatives.

The front portion 3 incorporates a bore 8 which extends through the length of the portion. A piston generally referenced 9 is located inside the casing of the cartridge in order to slidably displace in the longitudinal direction. Piston 9 incorporates a head 10 and an arm 11. The arm may be cylindrical in the cross-section with an outer diameter chosen to fit inside bore 8 of front portion 3. From the head 10 to the piston's arm front most portion 12, a bore 13 is provided.

The front most portion of head 10 incorporates a tapered flange 14 angled to match the tapered abutment 15 of front casing portion 3. The rear portion 2 also comprises an abutment which is referenced 16 in the figure. The displacement of the piston within the cartridge casing is therefore limited between abutment 16 at the rear of the cartridge and abutment 15 at its front portion. FIG. 1 shows piston 9 against abutment 16 which would be its position prior to detonation.

Figure 2:
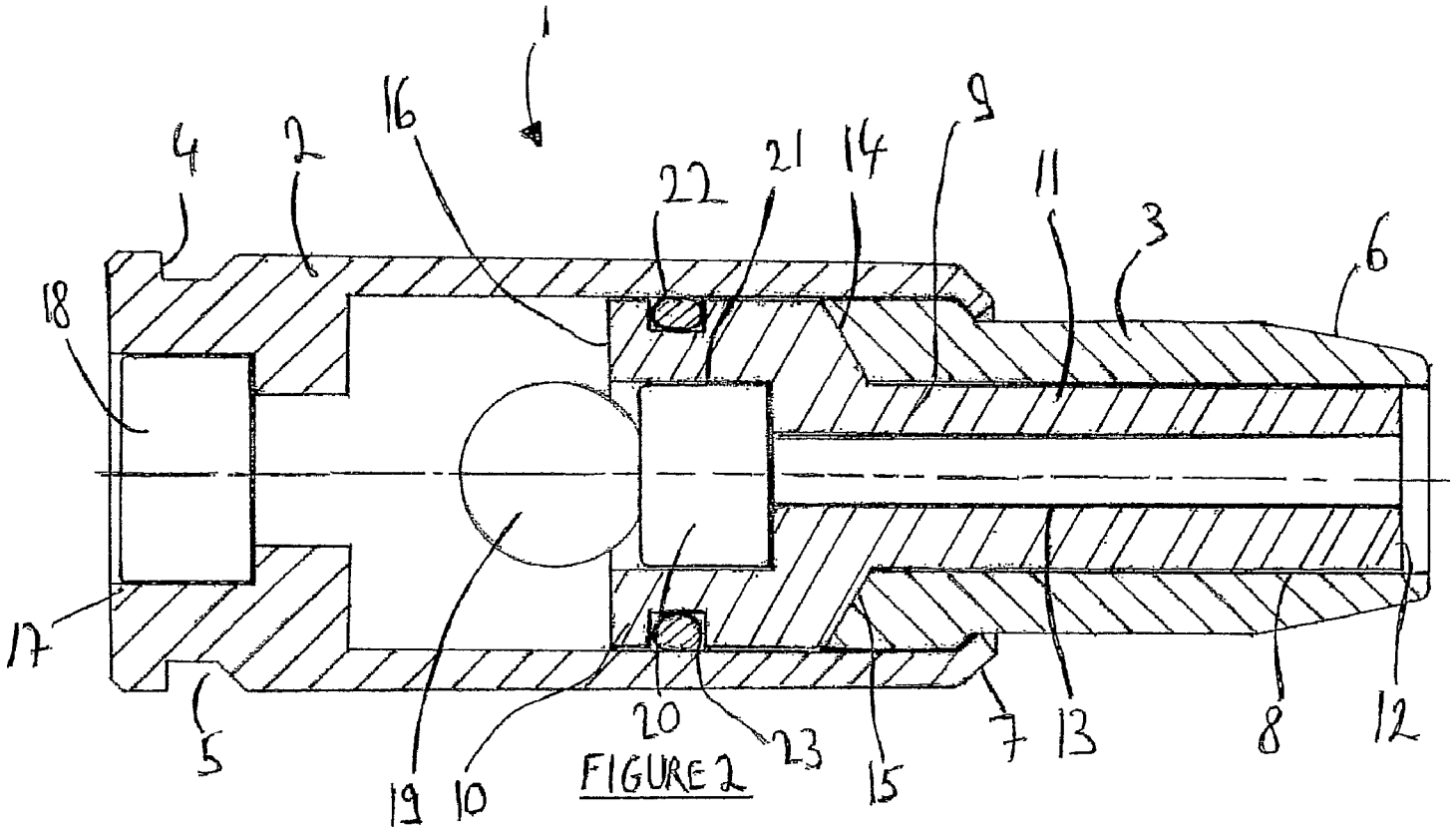
FIG. 2 shows a cross-sectional view of a blank cartridge following detonation.

FIG. 2, by contrast, shows piston 9 abutted against tapered portion 15. As can be seen by reference to both FIGS. 1 and 2, the piston is located entirely within the casing portions whether prior to detonation or after detonation.

In a rear most recess 17, a primer 18 is housed which upon detonation drives a projectile which, in this embodiment, is the form of a ball 19 into a second primer 20 located in a recessed portion 21 of the piston's head 10. The ball may be mainly of aluminium or plastics. The pressure exerted by the detonation of primer 18 causes the piston to displace in the longitudinal direction. In order to prevent the escape of propellant gases, a seal 22 located in an annular recess 23 is provided. Primer 20 is detonated by the ball 19 and discharges through bore 13.

Figure 3:
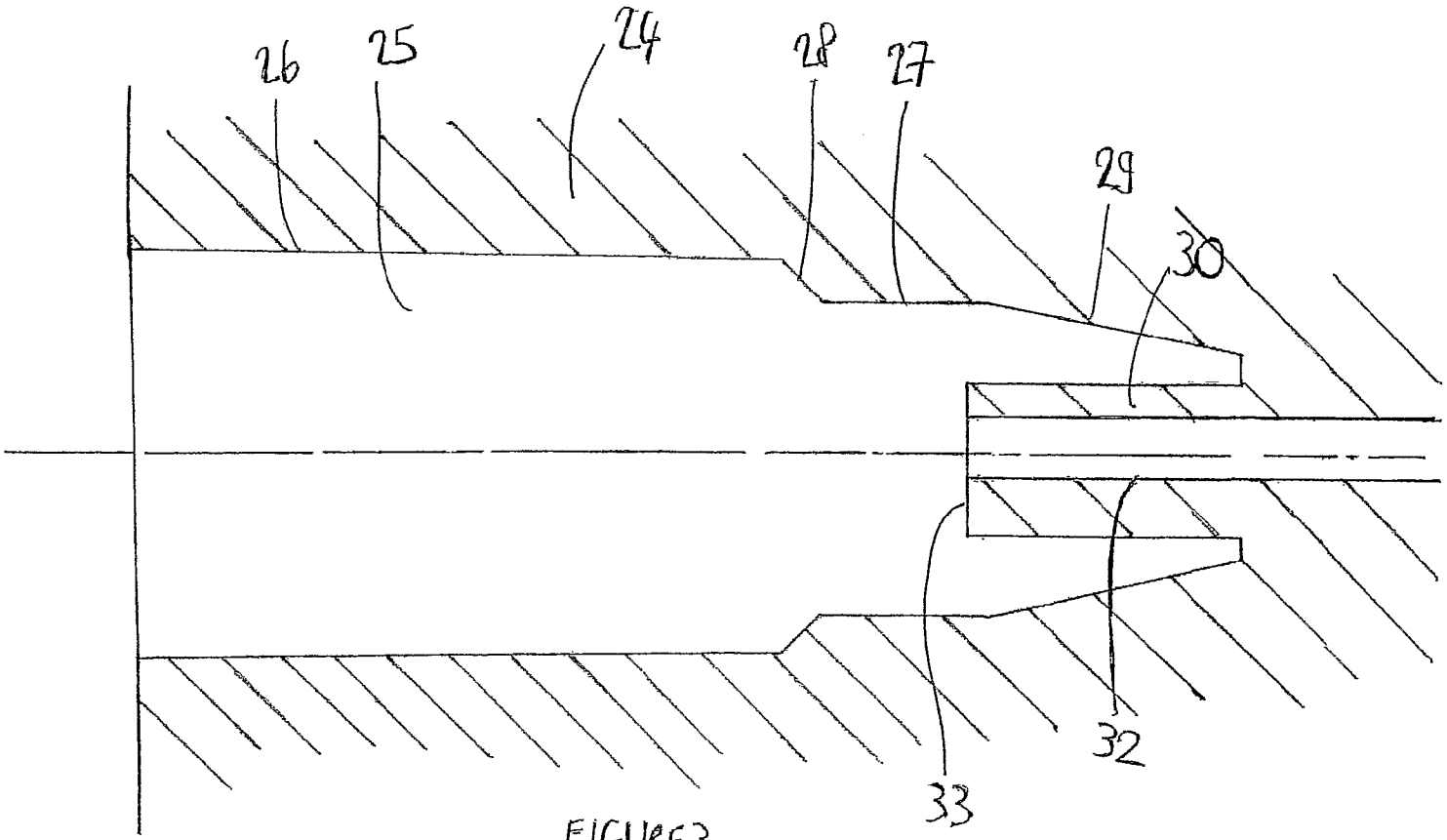
FIG. 3 shows a cross-sectional view of a receiving portion of the breech of a gun.

FIG. 3 shows a breech body 24 of a typical gun barrel conversion suitable for use with the cartridges of FIGS. 1 and 2. The breech body 24 has a chamber 25 with a first diameter 26 corresponding to the first diameter of cartridge 1. It also has a second diameter 27 corresponding to the second diameter of cartridge 1. Similarly, tapered portions 28 and 29 are configured to correspond to tapered portions referenced respectively 7 and 6 in FIGS. 1 and 2. A spigot 30 is provided in the breech body, it is so shaped to fit in the recessed portion 31 in the front of the cartridge as shown in FIG. 1. Spigot 30 comprises a bore 32 whose diameter matches closely the diameter of bore 13 of piston arm 11. As described above following detonation, the piston 9 moves forwards and thereby connects with end surface 33 of spigot 30 which drives the cartridge backwards out of the breech.

Figure 4:
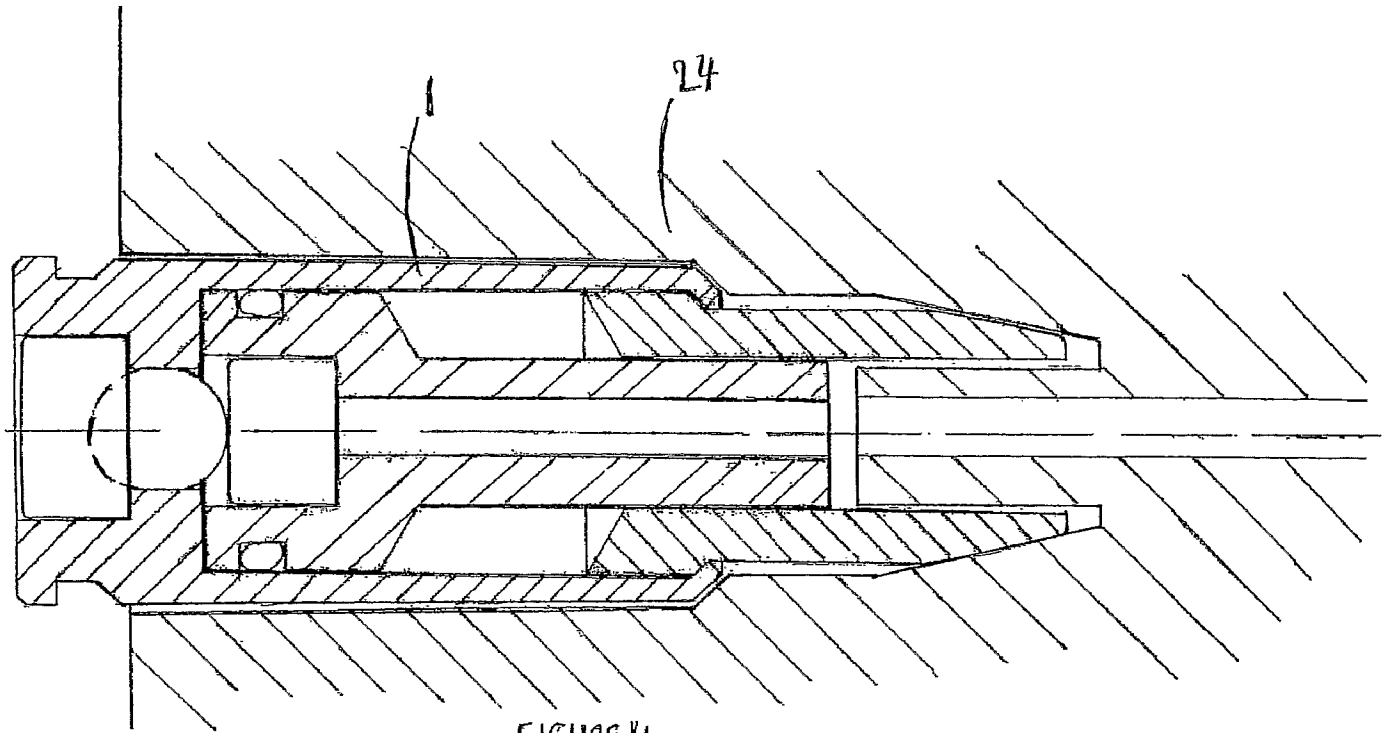
FIG. 4 shows a cross-sectional view of a cartridge in the receiving portion of a breech prior to detonation.

FIG. 4 shows the assembly of a cartridge 1 in a breech body 24, the detailed features of the cartridge and breech body have already been described with reference to FIGS. 1, 2 and 3 and have therefore been left out for clarity. The position shown in FIG. 4 is prior to detonation.

Figure 5:
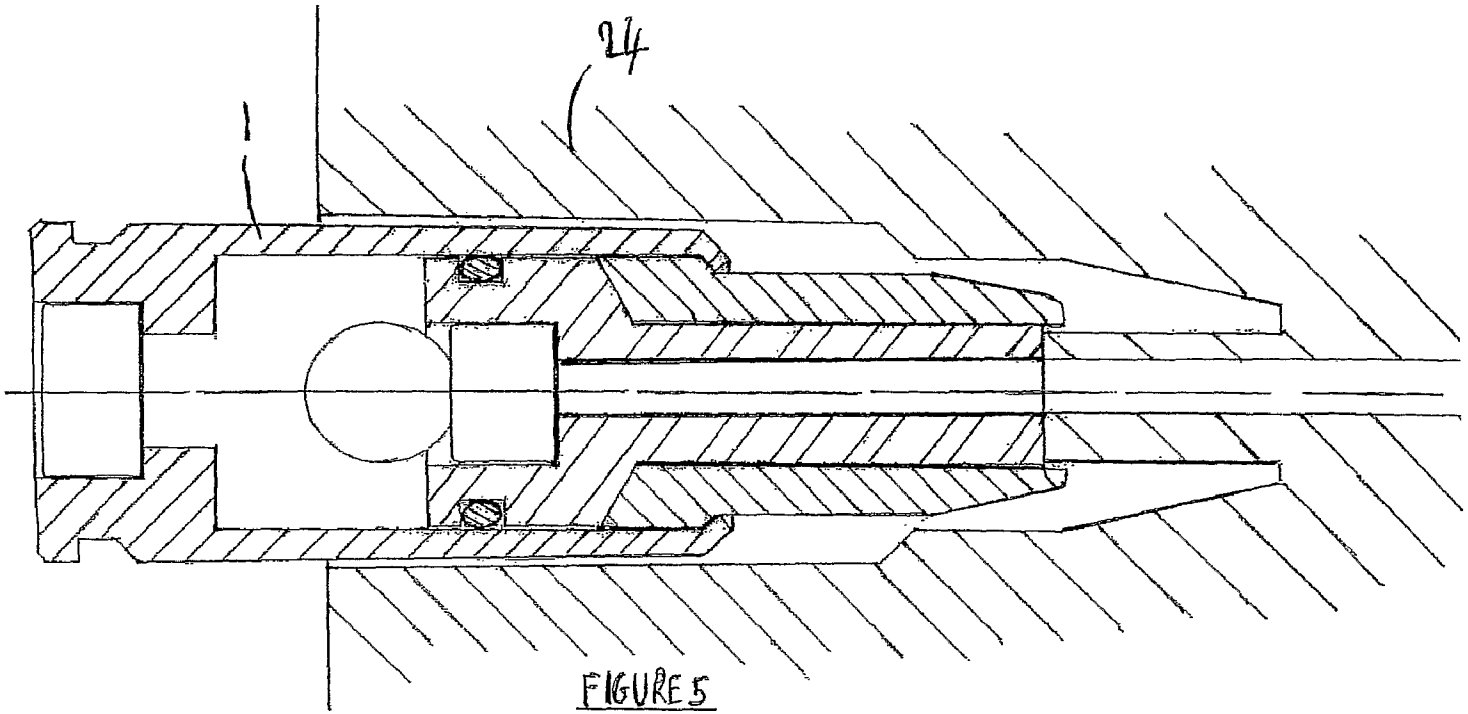
FIG. 5 shows a cross-sectional view of a cartridge in a breech receiving portion following detonation and during ejection.

FIG. 5 also shows cartridge 1 with breech body 24 after detonation where the piston has acted against the spigot to eject the cartridge from the breech body.

The invention also envisages alternative embodiments of this invention where, for example, either or any combination of the following features are not present: the ball, the second primer and the piston bore. The removal of all of these features will generate a silent blank instead of the blank described in the figures which would achieve noise levels closely mirroring if not identical to live cartridges.

Figure 6:
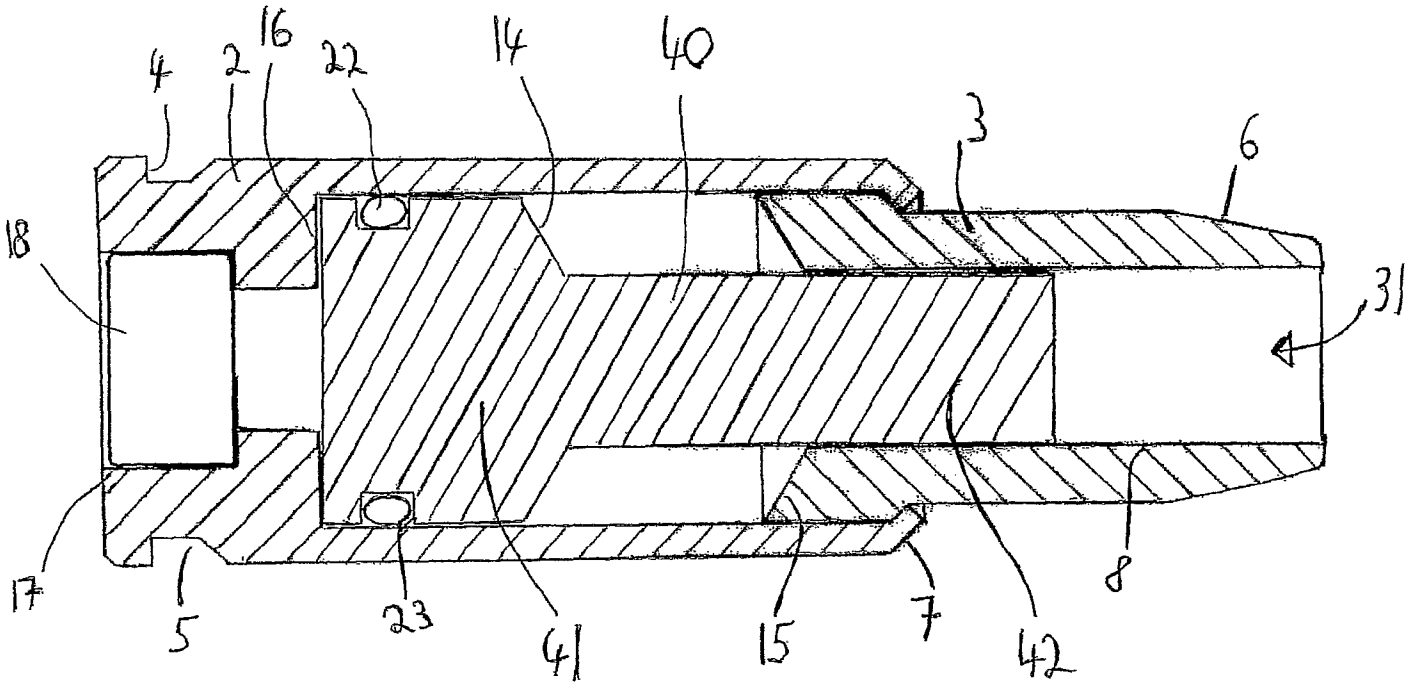
FIG. 6 shows a cross-sectional view of a blank cartridge prior to detonation.

FIG. 6 shows an example of a blank cartridge shaped and configured in a similar fashion to the cartridge of FIG. 1. Identical elements have retained identical numerical references.

A piston generally referenced 40 is located inside the casing of the cartridge in order to slidably displace in the longitudinal direction. Piston 40 incorporates a head 41 and an arm 42. The arm may be cylindrical in cross-section with a diameter chosen to fit inside bore 8 of front portion 3. No central bore is provided in the longitudinal direction in this embodiment.

Figure 7:
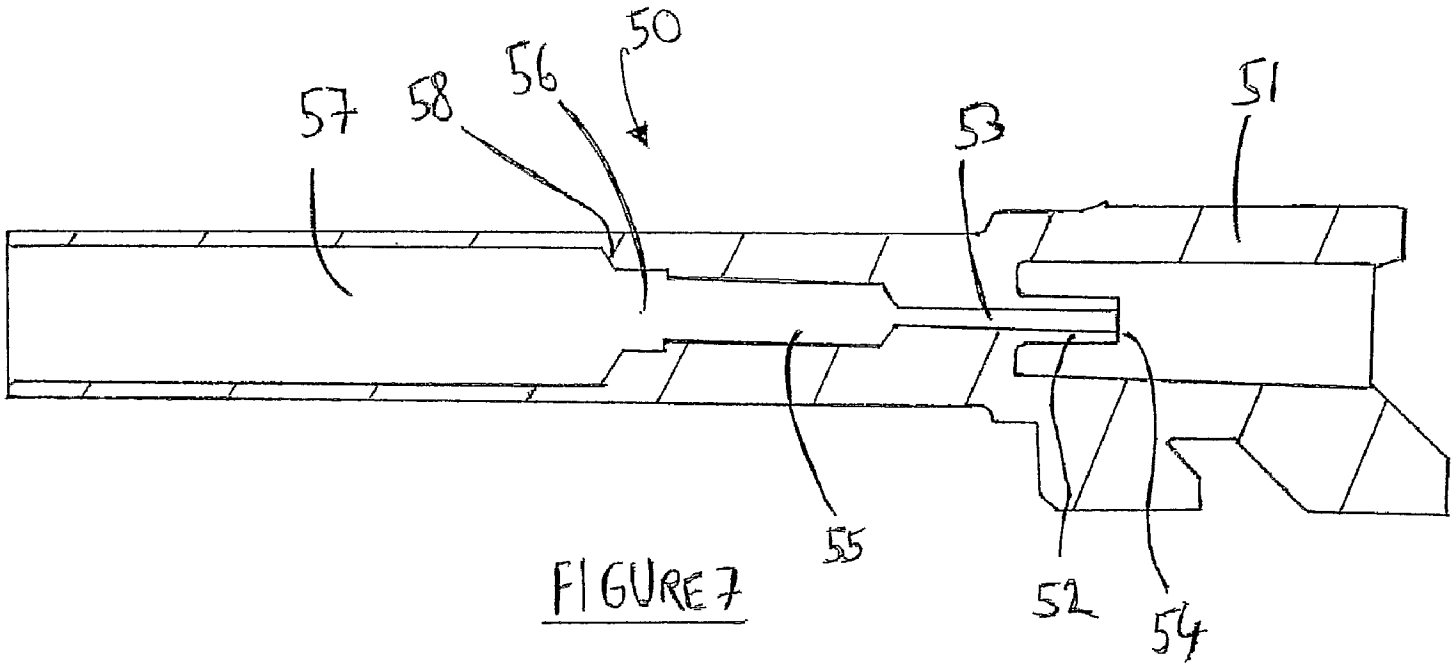
FIG. 7 shows a cross-sectional view of an adapter.

FIG. 7 shows an adapter 50 for fitting into a particular gun in order to perform a gin conversion. Rear portion 51 incorporates a body of the kind described in FIG. 3 i.e. suitable for receiving a cartridge. The adapter incorporates a spigot 52 which comprises a bore 53 whose diameter matches closely the diameter of the bore of the cartridge's piston arm. As described above following detonation, the piston of the cartridge moves forwards and thereby connects with end surface 54 of spigot 52 which drives the cartridge backwards out of the breech. The adapter incorporates a succession of bores which are progressively of wider diameter from bore 53 to the forward most extremity of the adapter. These bores are respectively referenced 55, 56 and 57. A tapered portion is provided between bores 56 and 57.

In addition the outer configuration of the adapter is configured to match the receiving portion of a gun. Projections may be provided to interlock with the gun to secure the adapter into place relative to the gun.

The scope of the present invention is defined in the claims that now follow.

The invention claimed is:

1. A blank cartridge comprising:

a cartridge casing with a first primer;

a piston with a head and an arm; and an expansion chamber located between said first primer and the head of the piston;

wherein, following detonation of the first primer, the piston slidably displaces completely within the casing of said cartridge in a longitudinal direction, such that the overall length of the cartridge in the longitudinal direction remains substantially constant during detonation; and wherein, prior to firing, the front of the cartridge forms between the casing and the arm of the piston a recessed portion with a front opening such that a portion of the arm of the piston is openly exposed to an environment external to the cartridge through the front opening before and after detonation.

2. A cartridge according to claim 1, wherein the expansion chamber forms a substantially closed chamber between the casing and the piston, and wherein the piston head incorporates a seal to prevent propellant gases from the explosion of the first primer escaping the expansion chamber.

3. A cartridge according to claim 1, wherein the piston incorporates a second primer and a channel extending from the second primer through the arm of the piston; and the expansion chamber incorporates a projectile which is projected, following detonation, by the explosion of the first primer onto the second primer.

4. A blank cartridge according to claim 1, wherein following detonation the arm of the piston is configured to displace in said recessed portion towards said front opening.

5. A blank cartridge comprising:

a cartridge casing with a first primer;

a piston with a head and an arm; and an expansion chamber located between said first primer and the head of the piston;

wherein, following detonation of the first primer, the piston slidably displaces within the casing of said cartridge, the entire piston remaining completely within the casing before and after detonation; and wherein, prior to firing, the front of the cartridge forms between the casing and the arm of the piston a recessed portion with a front opening such that a portion of the arm of the piston is openly exposed to an environment external to the cartridge through the front opening before and after detonation.

6. A cartridge according to claim 5, wherein the expansion chamber forms a substantially closed chamber between the casing and the piston, and wherein the piston head incorporates a seal to prevent propellant gases from the explosion of the first primer escaping the expansion chamber.

7. A cartridge according to claim 5, wherein the piston incorporates a second primer and a channel extending from the second primer through the arm of the piston; and the expansion chamber incorporates a projectile which is projected, following detonation, by the explosion of the first primer onto the second primer.

8. A blank cartridge according to claim 5, wherein following detonation the arm of the piston is configured to displace in said recessed portion towards said front opening.

9. A blank cartridge comprising:

a cartridge casing extending longitudinally between a front end and a back end, a first primer being disposed at the back end and a bore being formed at the front end, the bore extending longitudinally into the cartridge casing from a front end face;

a piston disposed completely within the cartridge casing, the piston comprising a head and an arm extending longitudinally from the head, the arm of the piston extending into the bore of the cartridge casing, the bore of the cartridge casing forming a front opening in said front end face, a portion of the arm of the piston being openly exposed to an environment external to the cartridge through the front opening prior to detonation of the primer; and an expansion chamber located between said first primer and the head of the piston;

wherein, following detonation of the first primer, the piston slidably displaces longitudinally within the casing of said cartridge such that the arm of the piston extends longitudinally further into the bore of the cartridge casing towards said front opening, the portion of the arm of the piston remaining openly exposed to the environment external to the cartridge through the front opening.

10. A cartridge according to claim 9, wherein the expansion chamber forms a substantially closed chamber between the casing and the piston, and wherein the piston head incorporates a seal to prevent propellant gases from the explosion of the first primer escaping the expansion chamber.

11. A cartridge according to claim 9, further comprising:

a second primer disposed between the first primer and the head of the piston, a channel extending through the piston from the second primer through the arm of the piston; and a projectile disposed within the expansion chamber, the projectile being projected onto the second primer, following detonation, by the explosion of the first primer.

12. A cartridge according to claim 9, wherein the overall longitudinal length of the cartridge remains substantially constant during detonation.

* * * * *